US006386415B1

(12) United States Patent
Tsai

(10) Patent No.: US 6,386,415 B1
(45) Date of Patent: May 14, 2002

(54) ADHESIVE TAPE FEEDING APPARATUS FOR FEEDING TAPE AUTOMATICALLY AFTER CUTTING

(75) Inventor: Jeff Tsai, Hsin-Chuang (TW)

(73) Assignee: Polymicro System Inc., Taipei (TW)

( * ) Notice: Subject to any disclaimer, the term of this patent is extended or adjusted under 35 U.S.C. 154(b) by 0 days.

(21) Appl. No.: 09/748,265

(22) Filed: Dec. 27, 2000

(51) Int. Cl.[7] ..... B26F 3/02
(52) U.S. Cl. ..... 225/11; 225/23
(58) Field of Search ..... 225/11, 10, 15, 225/23; 83/204, 205, 242, 176, 399, 586, 649, 922, 263, 949

(56) References Cited

U.S. PATENT DOCUMENTS 2,655,372 A * 10/1953 Hempel ..... 83/242 X
3,122,955 A * 3/1964 Eisenman ..... 83/922 X
3,465,629 A * 9/1969 Krueger ..... 83/205
3,466,963 A * 9/1969 Palson et al. ..... 83/922 X
3,515,324 A * 6/1970 Ogawa ..... 225/11
3,690,531 A 9/1972 Tanigami ..... 226/136
3,747,816 A * 7/1973 Se-Kit ..... 83/204 X
5,048,737 A * 9/1991 Sueda et al. ..... 225/11

* cited by examiner

*Primary Examiner*—M. Rachuba
*Assistant Examiner*—Jason Prone
(74) *Attorney, Agent, or Firm*—Finnegan, Henderson, Farabow, Garrett & Dunner, L.L.P.

(57) ABSTRACT

An adhesive tape feeding apparatus includes a base, an adjustment unit, and a push unit. A tape roll is disposed rotatably on a rear end portion of the base. When a motor is activated, a free end portion of the tape roll is fed from a front end portion of the base by means of a feeding roller set. The free end portion of the tape roll can be forced to press against a blade under tension, which is fixed on the base, so as to be cut by the blade, thereby moving a push unit to press a follower arm of the adjustment unit against a microswitch. Then, the microswitch activates the motor to rotate a cam wheel in such a manner that the cam wheel presses the follower arm against the microswitch. The cam wheel has an outer periphery which is shaped so as to release the follower arm automatically from the cam wheel and the push unit after the cam wheel rotates by a predetermined angle, thereby feeding a predetermined length of the tape roll, which can be changed by adjusting the adjustment unit.

8 Claims, 6 Drawing Sheets

ADHESIVE TAPE FEEDING APPARATUS FOR FEEDING TAPE AUTOMATICALLY AFTER CUTTING

BACKGROUND OF THE INVENTION

1. Field of the Invention

This invention relates to an adhesive tape feeding apparatus, more particularly to an adhesive tape feeding apparatus, which can feed automatically a predetermined length of a free end portion of a tape roll therefrom after the latter is cut off.

2. Description of the Related Art

A conventional tape feeding apparatus has been disclosed in U.S. Pat. No. 3,690,531, which can feed automatically a predetermined length of a free end portion of a tape roll therefrom after the latter is cut off. However, the aforesaid conventional tape feeding apparatus has a relatively complicated structure that results in an increased manufacturing cost.

SUMMARY OF THE INVENTION

The object of this invention is to provide an adhesive tape feeding apparatus, which has a relatively simple structure.

According to this invention, an adhesive tape feeding apparatus includes a base, an adjustment unit, and a push unit. A tape roll is disposed rotatably on a rear end portion of the base. When a motor is activated, a free end portion of the tape roll is fed from a front end portion of the base by means of a feeding roller set. The free end portion of the tape roll can be forced to press against a blade under tension, which is fixed on the base, so as to be cut by the blade, thereby moving a push unit to press a follower arm of the adjustment unit against a microswitch. Then, the microswitch activates the motor to rotate a cam wheel in such a manner that the cam wheel presses the follower arm against the microswitch. The cam wheel has an outer periphery which is shaped so as to release the follower arm automatically from the cam wheel and the push unit after the cam wheel rotates by a predetermined angle, thereby feeding a predetermined length of the free end portion of the tape roll, which can be changed by adjusting the adjustment unit between a first-length position and a second-length position.

In one embodiment, the outer periphery of the cam wheel has a short linear portion, a short circular arc portion, a long linear portion that is longer than the short linear portion, and a long circular arc portion that is longer than the short circular arc portion. Each of the long and short linear portions interconnects the long and short circular arc portions. The follower arm is spaced apart from the center of the cam wheel at a distance which is larger than that between the center of the cam wheel and either of the long and short linear portions when the adjustment unit is disposed at the second-length position, and which is larger than that between the center of the cam wheel and the long linear portion and smaller than that between the center of the cam wheel and the short linear portion when the adjustment unit is disposed at the first-length position.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
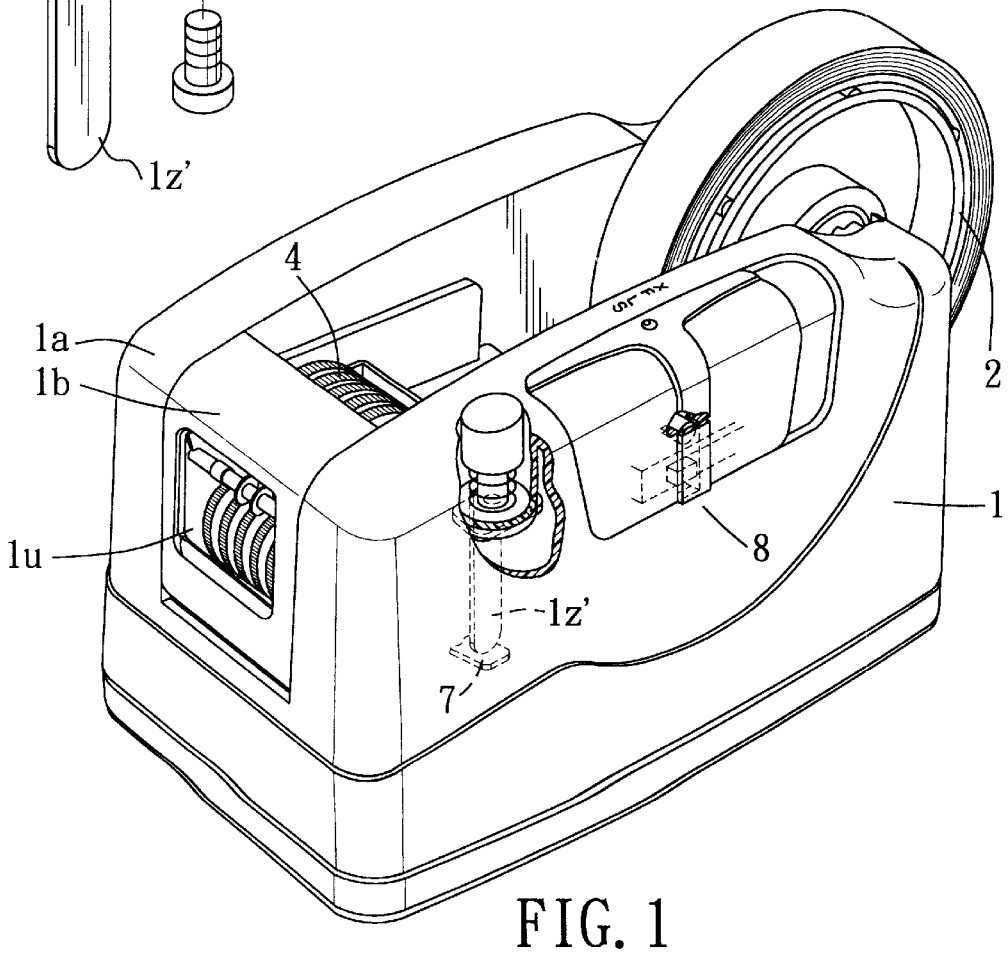
FIG. 1 is a perspective view of the preferred embodiment of an adhesive tape feeding apparatus according to this invention.
Figure 2A:
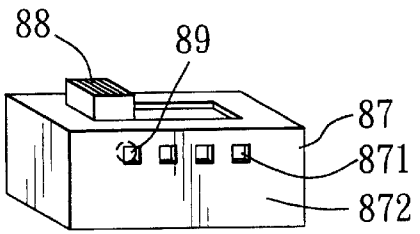
FIG. 2A is a perspective view of a positioning casing of the preferred embodiment, illustrating four positioning openings, which are formed in a bottom wall of the positioning casing.
Figure 2:
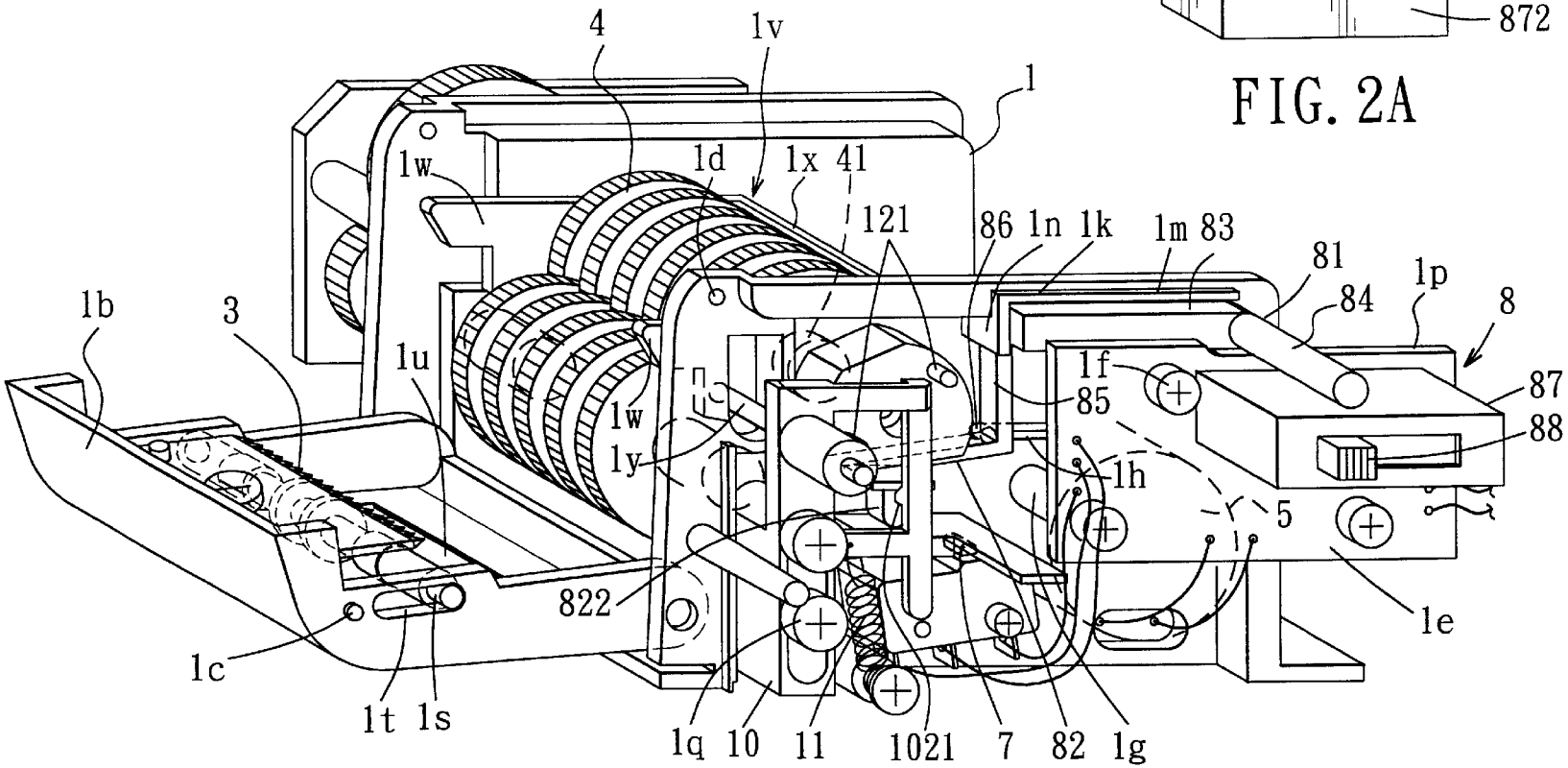
FIG. 2 is a fragmentary perspective view of the preferred embodiment, wherein an upper end of a front wall unit of a base of the preferred embodiment is turned forwardly from its normal position for illustrating the structures of a swing member and a feeding roller set.
Figure 3:
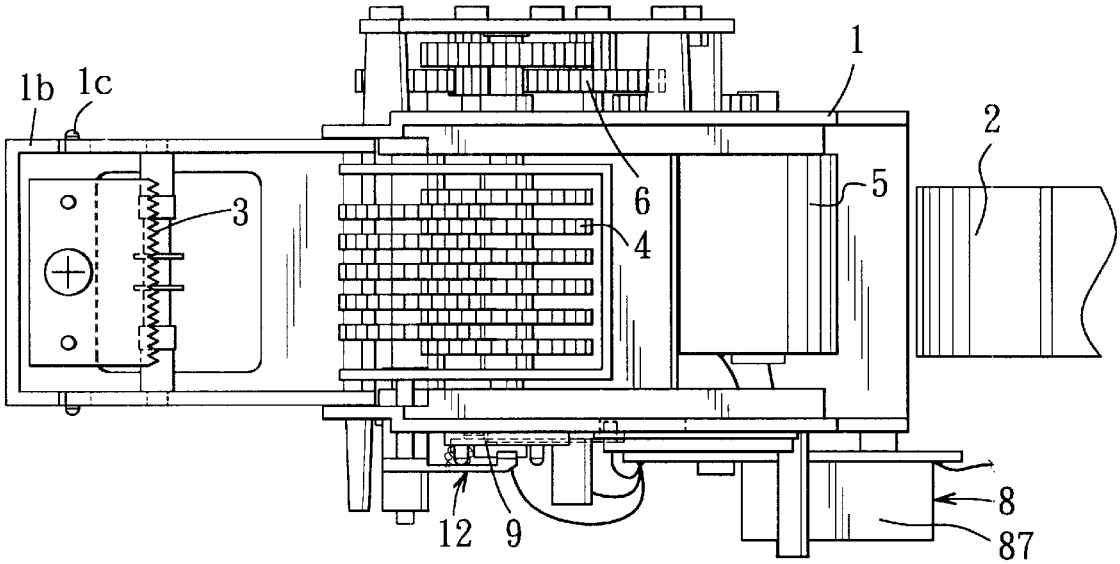
FIG. 3 is a top view of the preferred embodiment, wherein the upper end of the front wall unit is turned forwardly from its normal position to a generally horizontal position.

Referring to FIGS. 1, 2, 3 and 4, the preferred embodiment of an adhesive tape feeding apparatus according to this invention is shown to include a base 1, a rotary member 2, a blade 3 (see FIGS. 2 and 3), a feeding roller set 4, a motor 5, a reduction gearing 6 (see FIG. 3), a microswitch 7 (see FIG. 2), an adjustment unit 8, a cam wheel 9, a push unit 10 (see FIG. 2), a coiled tension spring 11, and a release unit 12 (see FIG. 3).

The base 1 has a generally U-shaped body (1*a*) and a front wall unit (1*b*), which are made of a plastic material. The front wall unit (1*b*) has a lower end mounted pivotally on the U-shaped body (1*a*), and left and right side surfaces, which are formed with aligned projecting grains (1*c*) that engage two holes (1*d*) in the U-shaped body (1*a*) and that can be removed forcibly and forwardly from the same, as shown in FIGS. 2 and 3.

The rotary member 2 is disposed rotatably on a rear end portion of the base 1, and is adapted to sleeve a tape roll (not shown) thereon in a known manner, thereby mounting the tape roll rotatably on the base 1.

The blade 3 is fixed on the front wall unit (1*b*) of the base 1, and is adapted to cut a free end portion of the tape roll.

The feeding roller set 4 is disposed rotatably on the base 1 between the blade 3 and the rotary member 2, and is adapted to deliver the free end portion of the tape roll from the rear end portion of the base 1 to the front end portion of the base 1.

The motor 5 is disposed on a rear portion of the base 1 for rotating the feeding roller set 4.

The reduction gearing 6 interconnects the motor 5 and the feeding roller set 4 for transferring rotation of the motor 5 to the feeding roller set 4.

The microswitch 7 is disposed on the left side surface of the base 1, and is connected electrically to the motor 5. When the microswitch 7 is activated, the motor 5 runs.

Figure 1B:
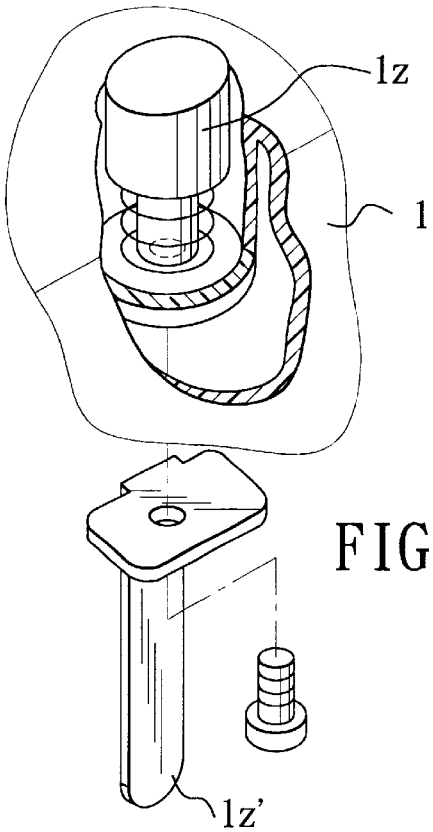
FIG. 1B is an enlarged perspective view of a pushbutton member of the preferred embodiment.
Figure 1A:
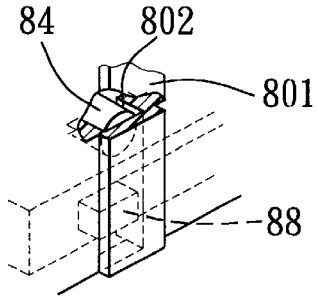
FIG. 1A is a schematic view of the preferred embodiment, illustrating how a movable knob is connected to a movable member and a contact element.
Figure 4:
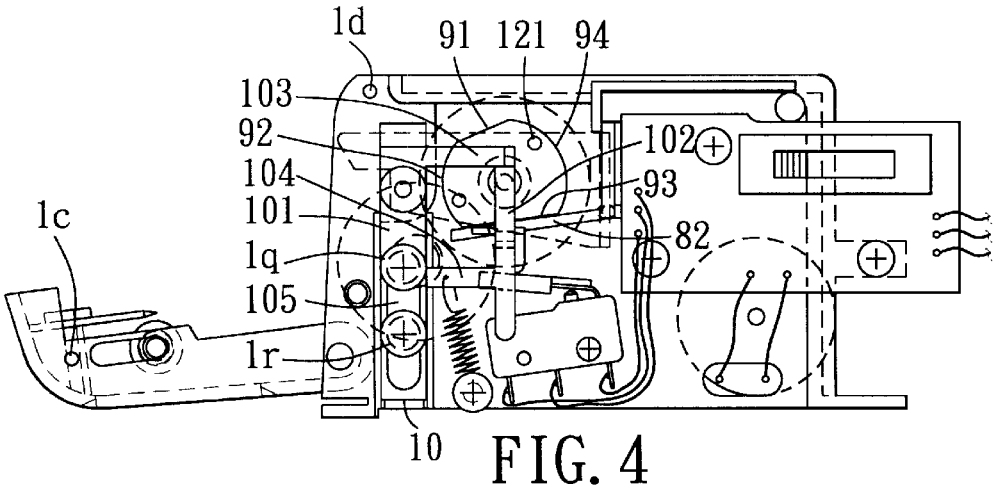
FIG. 4 is a schematic side view of the preferred embodiment, illustrating a first-length position of an adjustment unit.
Figure 5:
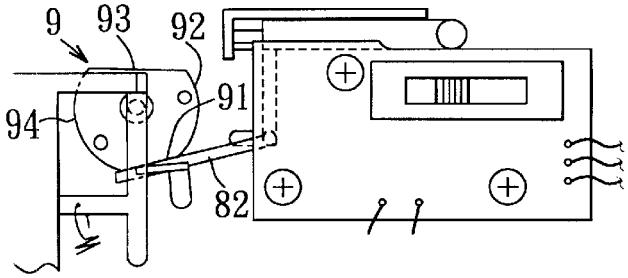
FIG. 5 is a schematic side view of the preferred embodiment, illustrating a second-length position of the adjustment unit.

The adjustment unit 8 is disposed horizontally and movably on the left side surface of the base 1, and is movable between a first-length position shown in FIG. 4 and a second-length position shown in FIG. 5. In this embodiment, the adjustment unit 8 includes a unitary plastic movable member 81 and an inclined resilient follower arm 82 that is disposed over the microswitch 7. The movable member 81 has a longitudinal horizontal portion 83, a transverse horizontal portion 84 extending perpendicularly from a rear end of the longitudinal horizontal portion 83, and a vertical portion 85 extending downward from a front end of the longitudinal horizontal portion 83. The follower arm 82 extends integrally, forwardly and downwardly from a lower end of the vertical portion 85. A vertical integrated circuit board (1*e*) is mounted fixedly on the left side surface of the base 1 by inserting several bolts (1*f*) through holes in the board (1*e*) to engage several threaded holes in several spacer rails (1*g*), which are formed integrally on the left side surface of the base 1. As illustrated, the integrated circuit board (1*e*) is connected to the microswitch 7 by means of several electrical cables. The movable member 81 further has an integral sliding element 86, which is received slidably within a horizontal slide slot (1*h*) that is formed in the left side surface of the base 1. An L-shaped guide rib (1*k*) is formed integrally on the left side surface of the base 1, and has a horizontal portion (1*m*) that abuts against a top side of the longitudinal horizontal portion 83 of the movable member 81, and a vertical portion (1*n*) that extends integrally and downwardly from a front end of the horizontal portion (1*m*). The transverse horizontal portion 84 of the movable member 81 can move on a horizontal upper edge (1*p*) of the integrated circuit board (1*e*). As such, the movable member 81 is confined between the left side surface of the base 1 and the integrated circuit board (1*e*), and is guided to move horizontally on the base 1. The adjustment unit 8 further includes a positioning casing 87 that is formed with four positioning openings 871 (see FIG. 2A) in a bottom surface 872 thereof, a contact element 88 that is disposed movably within the casing 87, and a spring-biased ball 89 that is attached to the contact element 88 for moving synchronously therewith and that can be positioned within a selected one of the positioning openings 871. A movable knob 801 is disposed slidably on the base 1, and has an inner surface with a vertical retaining slot 802, within which the transverse horizontal portion 84 of the movable member 81 and the contact element 88 are engaged, as shown in FIG. 1A. Accordingly, when the movable knob 801 is actuated, the transverse horizontal portion 84 of the movable member 81 and the contact element 88 move horizontally on the base 1. The movable knob 801 can be moved to a selected one of first, second, third and fourth positions (L, S, F, and X), which English letters are preferably indicated on a top surface of the base 1. When the movable knob 801 is disposed at the first position (L), the adjustment unit 8 is located at the first-length position shown in FIG. 4, where the front end of the longitudinal horizontal portion 83 of the movable member 81 abuts against the vertical portion (1*n*) of the guide rib (1*k*). When the movable knob 801 is disposed at the second-length position (S), the adjustment unit 8 is located at the second-length position shown in FIG. 5.

The cam wheel 9 is mounted coaxially and fixedly on the left end of a roller shaft 41 of the feeding roller set 4 for rotating synchronously with the same. In this embodiment, the cam wheel 9 has an outer periphery, which has a short linear portion 91, a short circular arc portion 92, a long linear portion 93 that is longer than the short linear portion 91, and a long circular arc portion 94 that is longer than the short circular arc portion 92. Each of the long and short linear portions 93, 91 interconnects the long and short circular arc portions 94, 92.

When the adjustment unit 8 is disposed at the first-length position shown in FIG. 4, the distance between the follower arm 82 and the center of the cam wheel 9 is larger than that between the center of the cam wheel 9 and the long linear portion 93, and smaller than that between the center of the cam wheel 9 and the short linear portion 91. When the adjustment unit 8 is disposed at the second-length position shown in FIG. 5, the follower arm 82 is spaced apart from the center of the cam wheel 9 at a distance which is larger than that between the center of the cam wheel and either of the long and short linear portions 93, 91.

The push unit 10 is unitary, and includes a front post 101, a rear post 102, an upper rail 103, and a lower rail 104. Each of the upper and lower rails 103, 104 interconnects the front and rear posts 101, 102. The front post 101 has a lower portion that is formed with a vertical slide slot 105. Two bolts (1*q*) (see FIGS. 2 and 4) are engage respectively within threaded holes in two spacer rails (1*r*) (shown by the phantom lines in FIG. 4), which are formed integrally on the left side surface of the base 1 and which are received slidably within the vertical slide slot 105 in the front post 101, thereby guiding the push unit 10 to move vertically on the base 1.

The tension spring 11 pulls the push unit 10 to move downwardly on the base 1.

The release unit 12 includes two outwardly extending horizontal pushing rods 121 (see FIG. 2), which are formed integrally on a vertical outer surface of the cam wheel 9.

A horizontal sliding rod (1*s*) (see FIG. 2) has left and right ends, which are received within a lower end of a vertical slide slot unit (1*t*) (see FIG. 2) that is formed in the front wall unit (1*b*) of the base 1. The blade 3 is disposed immediately behind an upper end of a window (1*u*), which is formed in the front wall unit (1*b*) of the base 1. A U-shaped swing member (1*v*) includes two left and right swing arms (1*w*) that are disposed rotatably on the roller shaft 41 of the feeding roller set 4 at intermediate portions thereof, and a connecting rail (1*x*) that interconnects the rear ends of the swing arms (1*w*). The front ends of the swing arms (1*w*) rest on the left and right ends of the sliding rod (1*s*) so that upward movement of the sliding rod (1*s*) results in upward turning of the front ends of the swing arms (1*w*). A horizontal pivot pin (1*y*) extends rotatably through an upper end portion of the front post 101 of the push unit 10 and the front end of the left swing arm (1*w*) of the swing member (1*v*).

Figure 6:
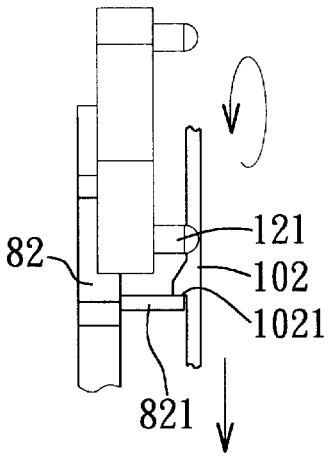
FIGS. 6 to 8 are schematic views, illustrating the operation of a push unit relative to a horizontal plate portion of a follower arm of the adjustment unit and a horizontal pushing rod of a cam wheel of the preferred embodiment.
Figure 7:
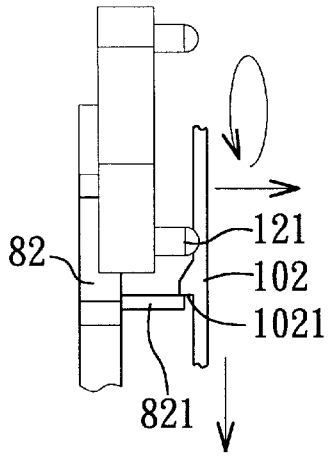
Figure 8:
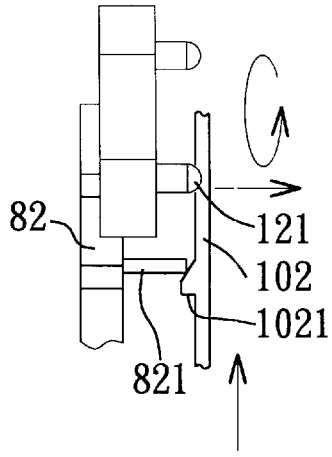
Figure 9A:
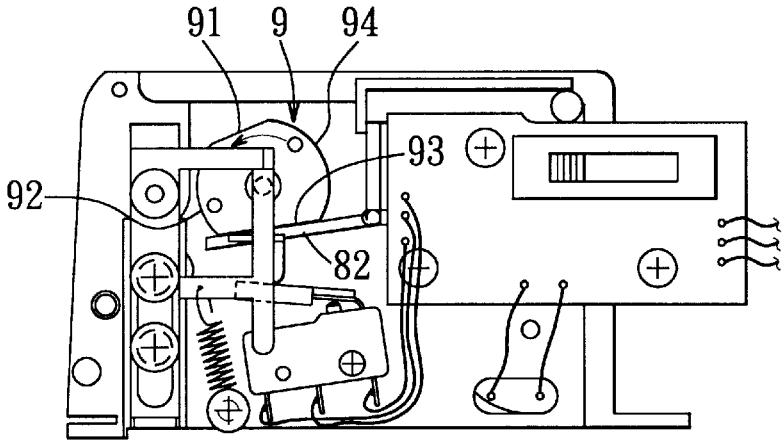
FIGS. 9A, 9B, 9C and 9D are schematic side views, illustrating the operations of the cam wheel and the follower arm of the preferred embodiment when the adjustment unit is disposed at the first-length position.
Figure 9B:
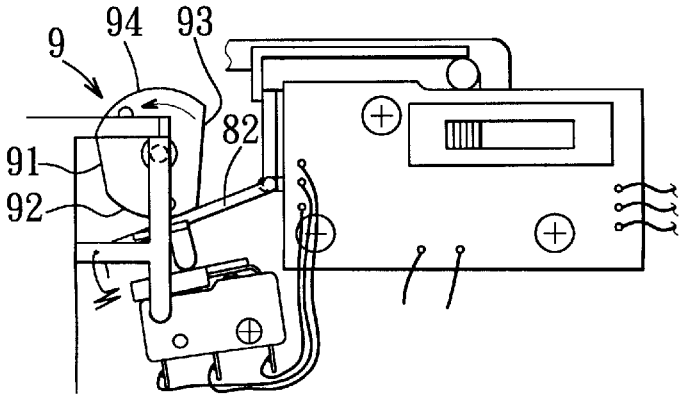

In operation, in a situation where a tape roll is sleeved on the rotary member 2, when the adjustment unit 8 is moved to the first-length position shown in FIG. 4, where the cam wheel 9 is located at the position shown in FIG. 9A relative to the follower arm 82, and when the microswitch 7 is activated, the motor 5 rotates the feeding roller set 4 so as to feed a first length of the free end portion of the tape roll from the window (1*u*) under the blade 3, which is in turn forced to press against a lower cutting edge of the blade 3 under tension so as to push the sliding rod (1*s*) and the front ends of the swing arms (1*w*) upward against the biasing action of the spring 11. As soon as the free end portion of the tape roll is cut by the blade 3, an upward pressure is released from the sliding rod (1*s*) and the swing arms (1*w*) so that the push unit 10 is pulled downward by the spring 11, thereby pressing a laterally extending projection 1021 (see FIG. 2) of the rear post 102 against a horizontal plate portion 821 of the follower arm 82 of the adjustment unit 8, as shown in FIG. 6. Under such a condition, a downwardly extending post 822 (see FIG. 2) of the follower arm 82 depresses and activates the microswitch 7 so as to start the motor 5, thereby rotating the cam wheel 9 counterclockwise. During rotation of the cam wheel 9, because the follower arm 82 is located at its front limit position, the outer periphery of the cam wheel 9 presses against the follower arm 82 except for the long linear portion 93, as shown in FIGS. 9A, 9B, 9C, and 9D. As such, when the cam wheel 9 rotates one revolution, it releases the follower arm 82 therefrom. In addition, during the one-revolution rotation of the cam wheel 9, the pushing rods 121 of the cam wheel 9 push the rear post 101 outwardly so that the horizontal plate portion 821 of the follower arm 82 slides upward over the projection 1021 of the rear post 101 of the push unit 10 by virtue of restoration force of the follower arm 82 per se, thereby removing the follower arm 82 from the microswitch 7, as shown in FIGS. 7 and 8. In this way, upon one vertical reciprocating movement of the push unit 10 by cutting the free end portion of the tape roll, the cam wheel 9 rotates only one revolution, during which the first length of the free end portion of the tape roll is fed from the window (1*u*).

Figure 10A:
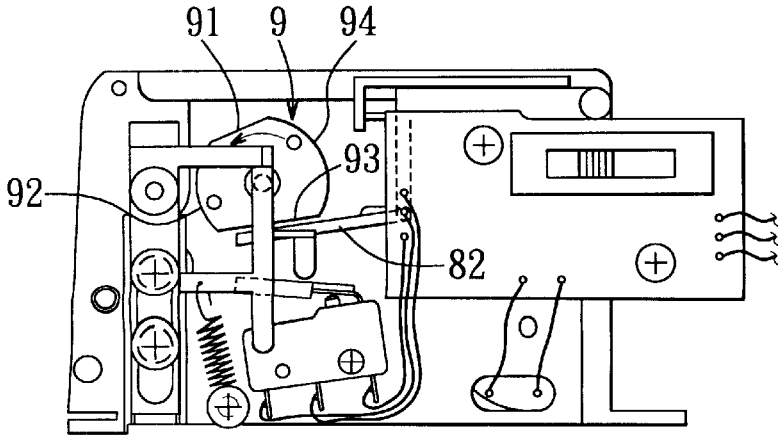
FIGS. 10A, 10B, 10C, and 10D are schematic side views, illustrating the operations of the cam wheel and the follower arm of the preferred embodiment when the adjustment unit is disposed at the second-length position.
Figure 10B:
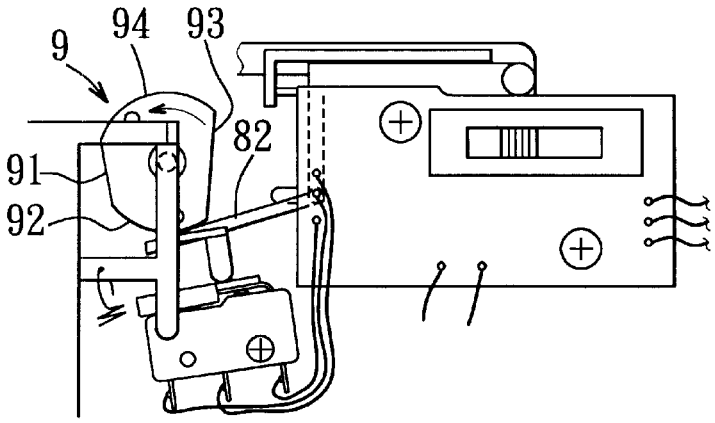
Figure 10C:
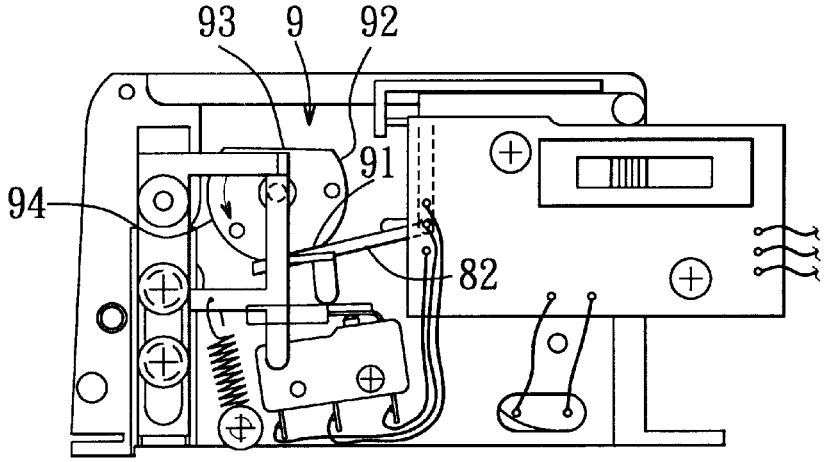
Figure 10D:
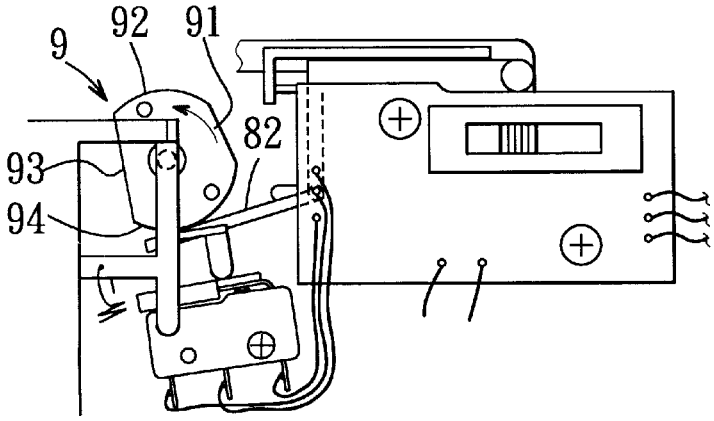

When the adjustment unit 8 is moved to the second-length position shown in FIG. 5, where the cam wheel 9 is located at the position shown in FIG. 10A or 10C relative to the follower arm 82, and when the microswitch 7 is activated, the motor 5 rotates the feeding roller set 4 so as to feed a second length of the free end portion of the tape roll from the window (1*u*) under the blade 3. Then, a tape cutting action is performed in the above manner so as to start the motor 5, thereby rotating the cam wheel 9 counterclockwise. During rotation of the cam wheel 9, because the follower arm 82 is located at a position that is somewhat behind its front limit position, the outer periphery of the cam wheel 9 can press against the follower arm 82 only by the long and short circular portions 94, 92, as shown in FIGS. 10A, 10B, 10C, and 10D. As such, when the cam wheel 9 rotates 180 degrees, it releases the follower arm 82 therefrom. In addition, during the 180-degree rotation of the cam wheel 9, one of the pushing rods 121 of the cam wheel 9 pushes the rear post 101 outwardly so as to remove the follower arm 82 from the microswitch 7. In this way, upon one vertical reciprocating movement of the push unit 10 by cutting the free end portion of the tape roll, the cam wheel 9 rotates only half revolution, during which the second length of the free end portion of the tape roll is fed from the window (1*u*). Accordingly, the first length is two times the second length.

Figure 9C:
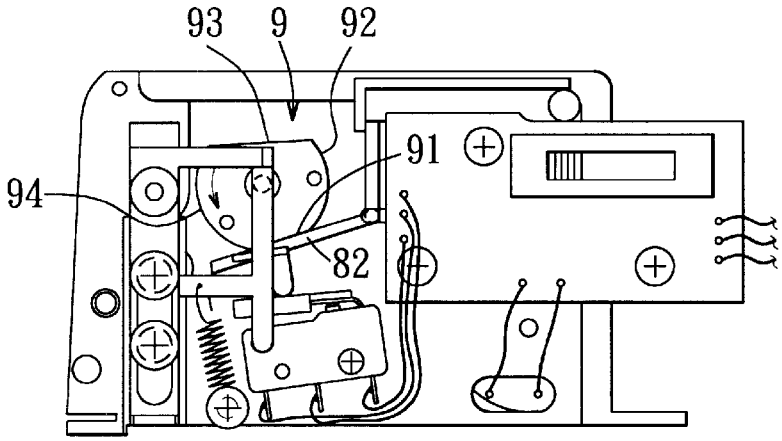
Figure 9D:
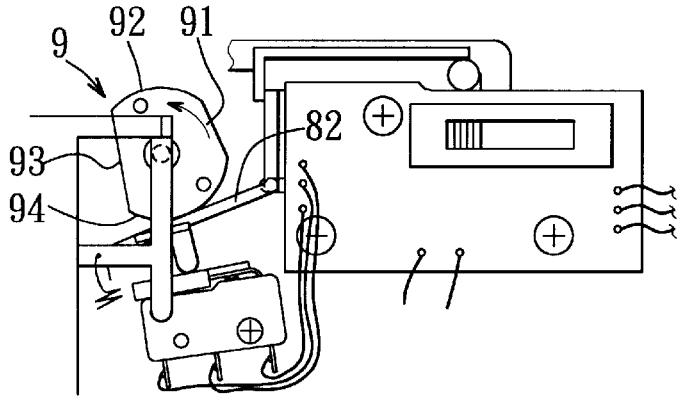

Note that when the adjustment unit 8 is moved from the position shown in FIG. 10C to that in FIG. 9C, a first tape cutting action results in only a half-revolution rotation of the cam wheel 9, after which the cam wheel 9 rotates to the position shown in FIG. 9A so as to stop the motor 5.

A spring-loaded pushbutton member (1*z*) is mounted operably on the front end portion of the base 1, and has a pushing portion (1*z*′) (see FIGS. 1 and 1B) that is disposed immediately over the microswitch 7, as shown in FIG. 1. When the movable knob 801 is moved to any one of the positions (L, S, and F), preferably to the position (F), the pushbutton member (1*z*) can be depressed continuously so as to press the pushing portion (1*z*′) against the microswitch 7, thereby feeding the free end portion of the tape roll from the window (1*u*) continuously until the pushbutton member (1*z*) is released.

When the movable knob 801 is moved to the position (X), the adjustment unit 8 moves to a non-feeding position shown by the phantom lines in FIG. 4, where the follower arm 82 is spaced apart from the microswitch 7 and where any portion of the cam wheel 9 cannot contact the follower arm 82 during rotation thereof and where the electrical connection between the motor 5 and the microswitch 7 is broken.

With this invention thus explained, it is apparent that numerous modifications and variations can be made without departing from the scope and spirit of this invention. It is therefore intended that this invention be limited only as indicated by the appended claims.

I claim:

1. An adhesive tape feeding apparatus for feeding a free end portion of an adhesive tape roll therefrom, said feeding apparatus comprising:

a base having a front end portion and a rear end portion;

a rotary member disposed rotatably on said rear end portion of said base and adapted to sleeve the tape roll thereon, thereby mounting the tape roll rotatably on said base;

a blade fixed on said front end portion of said base and adapted to cut the free end portion of the tape roll;

a feeding roller set disposed rotatably on said base between said blade and said rotary member and adapted to deliver the free end portion of the tape roll from said rear end portion of said base to said front end portion of said base;

a motor disposed on said base for rotating said feeding roller set;

a reduction gearing interconnecting said motor and said feeding roller set for transferring rotation of said motor to said feeding roller set;

a microswitch disposed on said base and connected electrically to said motor, said microswitch being capable of being activated to run said motor;

an adjustment unit disposed movably on said base and movable on said base between a first-length position, where said feeding roller set is adapted to deliver a first length of the free end portion of the tape forwardly therefrom, and a second-length position, where said feeding roller set is adapted to deliver a second length of the free end portion of the tape forwardly therefrom, said adjustment unit including a resilient follower arm which is located over and which is spaced apart from said microswitch;

a cam wheel connected to said feeding roller set so as to rotate synchronously therewith when said motor runs, and having an outer periphery that is spaced apart from said follower arm of said adjustment unit and that is rotatable to press said follower arm against said microswitch, said outer periphery of said cam wheel being shaped so as to release said follower arm therefrom after each rotation by a first angle when said adjustment unit is disposed at said first-length position, and by a second angle when said adjustment unit is disposed at said second-length position;

a push unit disposed movably on said base and movable to press said follower arm against said microswitch so as to start said motor when a force is applied to press the free end portion of the tape roll against said blade under tension so as to cut the free end portion of the tape roll;

a spring for biasing said push unit to press said follower arm against said microswitch when the free end portion of the tape roll is cut off by said blade; and a release unit for releasing said follower arm from said push unit during each rotation of said cam wheel when said adjustment unit is disposed at either of said first and second-length positions, thereby permitting subsequent action of said push unit to press said follower arm against said microswitch during a subsequent tape-cutting operation.

2. The adhesive tape feeding apparatus as claimed in claim 1, wherein said outer periphery of said cam wheel has a short linear portion, a short circular arc portion, a long linear portion that is longer than said short linear portion, and a long circular arc portion that is longer than said short circular arc portion, each of said long and short linear portions interconnecting said long and short circular arc portions, said follower arm being spaced apart from a center of said cam wheel at a distance which is larger than that between the center of said cam wheel and either of said long and short linear portions when said adjustment unit is disposed at said second-length position, and which is larger than that between the center of said cam wheel and said long linear portion and smaller than that between the center of said cam wheel and said short linear portion when said adjustment unit is disposed at said first-length position.

3. The adhesive tape feeding apparatus as claimed in claim 2, wherein said first angle is 360 degrees, said second angle being 180 degrees, said first length being two times said second length.

4. The adhesive tape feeding apparatus as claimed in claim 1, wherein said base includes a pushbutton member which is mounted operably thereon and which has a pushing portion near said microswitch, said pushbutton member being capable of being pressed continuously when said adjustment unit is located at either of said first-length and second-length positions, so as to press said pushing portion against said microswitch, thereby feeding the free end portion of the tape roll continuously from said feeding roller set until said pushbutton member is released.

5. The adhesive tape feeding apparatus as claimed in claim 1, further comprising an integrated circuit board that interconnects electrically said microswitch and said motor, said adjustment unit being movable to a non-feeding position, where electrical connection between said microswitch and said motor is broken.

6. The adhesive tape feeding apparatus as claimed in claim 1, wherein said push unit includes a rear post which is formed integrally with a laterally extending projection, said follower arm being formed integrally with a horizontal plate portion which is disposed under said cam wheel and over said projection when said adjustment unit is located at either of said first-length and second-length positions, said projection of said push unit moving upward against biasing action of said spring to a position above said horizontal plate portion of said follower arm when the force is applied to press the free end portion of the tape roll against the blade, and subsequently, when the free end portion of the tape roll is cut off by said blade, moving downward by virtue of the biasing action of said spring so as to depress said projection against said horizontal plate portion of said follower arm, thereby pressing said follower arm against said microswitch.

7. The adhesive tape feeding apparatus as claimed in claim 6, wherein said cam wheel has a vertical outer surface, said release unit including two horizontal pushing rods which extend respectively, integrally and outwardly from said outer surface of said cam wheel, said pushing rods being positioned relative to said rear post of said push unit so that at least one of said pushing rods pushes said rear post away from said outer surface of said cam wheel during each rotation of said cam wheel by either of said first and second angles, thereby permitting sliding movement of said horizontal plate portion of said follower arm of said adjustment unit over said projection and back to a position between said cam wheel and said projection of said push unit, where said horizontal plate portion of said adjustment unit is released from said projection of said push unit.

8. The adhesive tape feeding apparatus as claim 7, wherein said feeding roller set has a roller shaft, which is journalled within said base and which has an end that is connected coaxially and fixedly to said cam wheel, said base having a vertical slide slot unit formed in said front end portion thereof, said adhesive tape feeding apparatus further including:

a horizontal sliding rod which has left and right ends that are received slidably within a lower end of said slide slot unit and which is adapted to permit extension of the free end portion of the tape roll thereunder, said sliding rod being disposed under said blade so as to move upward in said slide slot unit when the free end portion of the tape roll is brought into contact with said blade; and a U-shaped swing member including two parallel left and right swing arms that are disposed rotatably on said roller shaft of said feeding roller set at intermediate portions thereof and that have front ends and rear ends, and a connecting rail which has left and right ends that are formed respectively and integrally with said rear ends of said swing arms, said front ends of said swing arms resting respectively on said left and right ends of said sliding rod so that upward movement of said sliding rod in said slide slot unit results in upward turning of said front ends of said swing arms, said push unit being connected to said front end of one of said swing arms of said swing member and being guided to move on said base in a generally vertical direction, whereby, when the free end portion of the tape roll is brought into contact with said blade, said push unit moves upward on said base against the biasing action of said spring; and, when the free end portion of the tape roll is subsequently cut off by said blade, said push unit moves downward on said base by virtue of the biasing action of said spring.

* * * * *